US005507236A

United States Patent [19]

Bruno

[11] Patent Number: 5,507,236

[45] Date of Patent: Apr. 16, 1996

[54] STEEL PALLET WITH CORRUGATED LOAD BEARING LAYER

[75] Inventor: Willemsen W. Bruno, Beaconsfield, Australia

[73] Assignee: Sixty Fifth Calejero Pty. Ltd., Victoria, Australia

[21] Appl. No.: 397,257

[22] PCT Filed: Aug. 24, 1993

[86] PCT No.: PCT/AU93/00431

§ 371 Date: Mar. 15, 1995

§ 102(e) Date: Mar. 15, 1995

[87] PCT Pub. No.: WO94/06693

PCT Pub. Date: Mar. 31, 1994

[30] Foreign Application Priority Data

Sep. 17, 1992 [AU] Australia ..... PL4764
Dec. 24, 1992 [AU] Australia ..... PL6565

[51] Int. Cl.[6] ..... B65D 19/00

[52] U.S. Cl. ..... 108/51.1

[58] Field of Search ..... 108/51.1, 51.3, 108/52.1, 56.1, 901

[56] References Cited

U.S. PATENT DOCUMENTS

| | | | |
|---|---|---|---|
| 3,405,666 | 10/1968 | Miller | 108/901 |
| 3,719,157 | 3/1973 | Arcochia | 108/901 |
| 5,425,521 | 6/1995 | Locke | 108/51.1 |

FOREIGN PATENT DOCUMENTS

| | | |
|---|---|---|
| 4912472 | 5/1974 | Australia . |
| 497729 | 8/1992 | European Pat. Off. . |
| 1115183 | 4/1962 | Germany . |
| 2224137 | 11/1973 | Germany . |
| 0686017 | 1/1953 | United Kingdom . |
| 2047657 | 12/1980 | United Kingdom . |
| 2127773 | 4/1994 | United Kingdom . |
| 9214654 | 9/1992 | WIPO . |

*Primary Examiner*—Peter M. Cuomo
*Assistant Examiner*—Gerald A. Anderson
*Attorney, Agent, or Firm*—Larson and Taylor

[57] ABSTRACT

A pallet (10) fabricated in steel having a base panel (20), a load bearing panel (30) and a top panel (40), the panels interfitting so that the load bearing panel is sandwiched between the top and base panels to define a sealed enclosure. The pallet has downwardly projecting legs (21, 22, 23 or 121, 122) which facilitate two or four way tyne entry.

11 Claims, 5 Drawing Sheets

41
40
6
10
30
33
37
32
31
34
32
33
31
36
20
2
4
5
3
51
51
23
22
26
25
21
25a
26a
27
51

STEEL PALLET WITH CORRUGATED LOAD BEARING LAYER

BACKGROUND OF THE INVENTION

This invention relates to pallets and especially though not exclusively to metal pallets. In particular, the invention relates to pallets that are formed of interfitting sections that are secured together to form the assembled pallet.

DISCUSSION OF PRIOR ART

Pallets are used in very large numbers in the freight industry especially in the container freight industry. The majority of pallets are manufactured from timber. Whilst such pallets are cheap and fairly reliable, they do deteriorate through use. Environmental concerns have placed restrictions on the widespread use of timber and thus pallet manufacturers have looked to other materials.

Metal pallets, especially steel pallets, have been in existence for many years. However, these pallets tend to be too heavy and expensive. Pallets made of plastics or fibre reinforced plastics have tended to be expensive and somewhat brittle.

When pallets are used in the food industry the issue of hygiene becomes paramount. It is very important that pallets can be easily cleaned. It is also very important that the pallet construction does not define nooks and crannies where food or liquids can collect resulting in active breeding sites for bacteria.

The present invention is concerned with producing a pallet in a material other than timber that addresses some of the problems discussed above. There is a need for a pallet that is not made of wood, which is comparatively light yet fulfils the load criterion dictated by the industry. The pallet should also be versatile in use, durable and hygienic.

SUMMARY OF THE INVENTION

According to the present invention there is provided a pallet fabricated in steel from a base panel, a load bearing panel and a top panel, the panels interfitting so that the load bearing panel is sandwiched between the top and base panels, the base panel having an upstanding peripheral side portion that terminates in an inwardly projecting upper flange, the top panel having a downwardly extending peripheral side portion that extends over and in contact with the side portion of the base panel with the underside of the top panel abutting the upper flange of the base panel, and means to secure and seal the overlapping side portions to define a sealed enclosure, the pallet having downwardly projecting legs which facilitate at least two way tyne entry.

Preferably the load bearing panel is corrugated with the corrugations in abutment with the top and base panels. The abutting surfaces Of the panels are preferably adhesively secured together.

In a preferred embodiment the abutting portions are coated with adhesive to secure the top panel to the base panel.

In the preferred embodiments the pallet has legs that can define either two way or four way unobstructed tyne access.

DESCRIPTION OF THE DRAWINGS

Embodiments of the present invention will now be described, by way of example only, with reference to the accompanying drawings in which.

DESCRIPTION OF THE PREFERRED EMBODIMENTS

In a first embodiment shown in FIGS. 1 to 3, 6 and 7, a pallet 10 allowing two way tyne entry comprise three major sections, namely a base panel 20, a bearing panel 30 and a top panel 40. The base, bearing and top panels interfit together to form the assembled pallet 10. In a preferred embodiment all the components are manufactured from steel. It is envisaged that the components could be made of mild steel, galvanised steel or stainless steel. It is further understood that the invention also embraces components produced from aluminium or fibre reinforced plastics. It is envisaged that if the componentry is manufactured from fibre reinforced plastics the components would be manufactured by pulltrusion. The following description relates to sections that are pressed, bent or rolled in steel.

Figure 3:
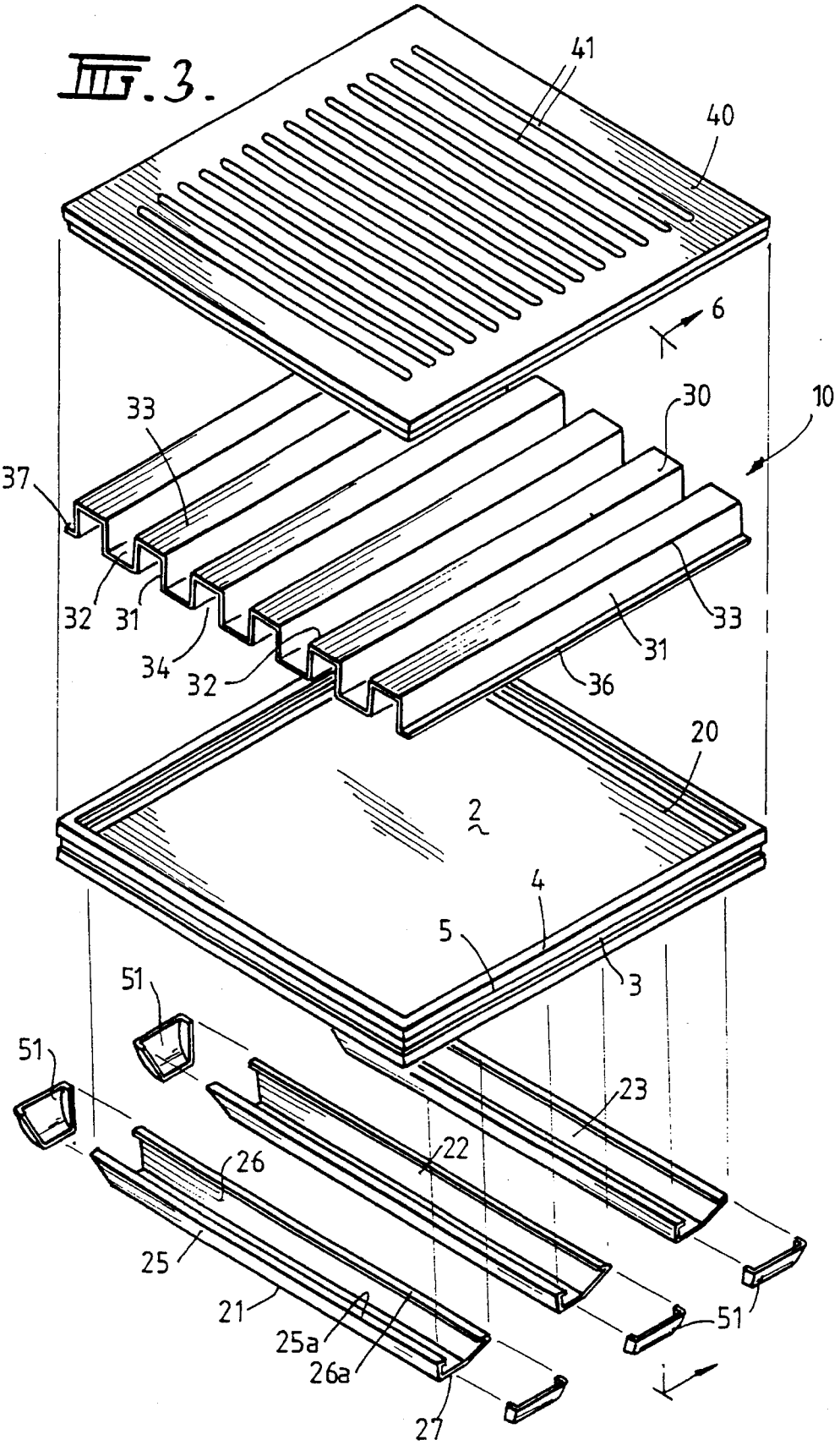
FIG. 3 is an exploded perspective view of the pallet shown in FIGS. 1 and 2.
Figure 6:
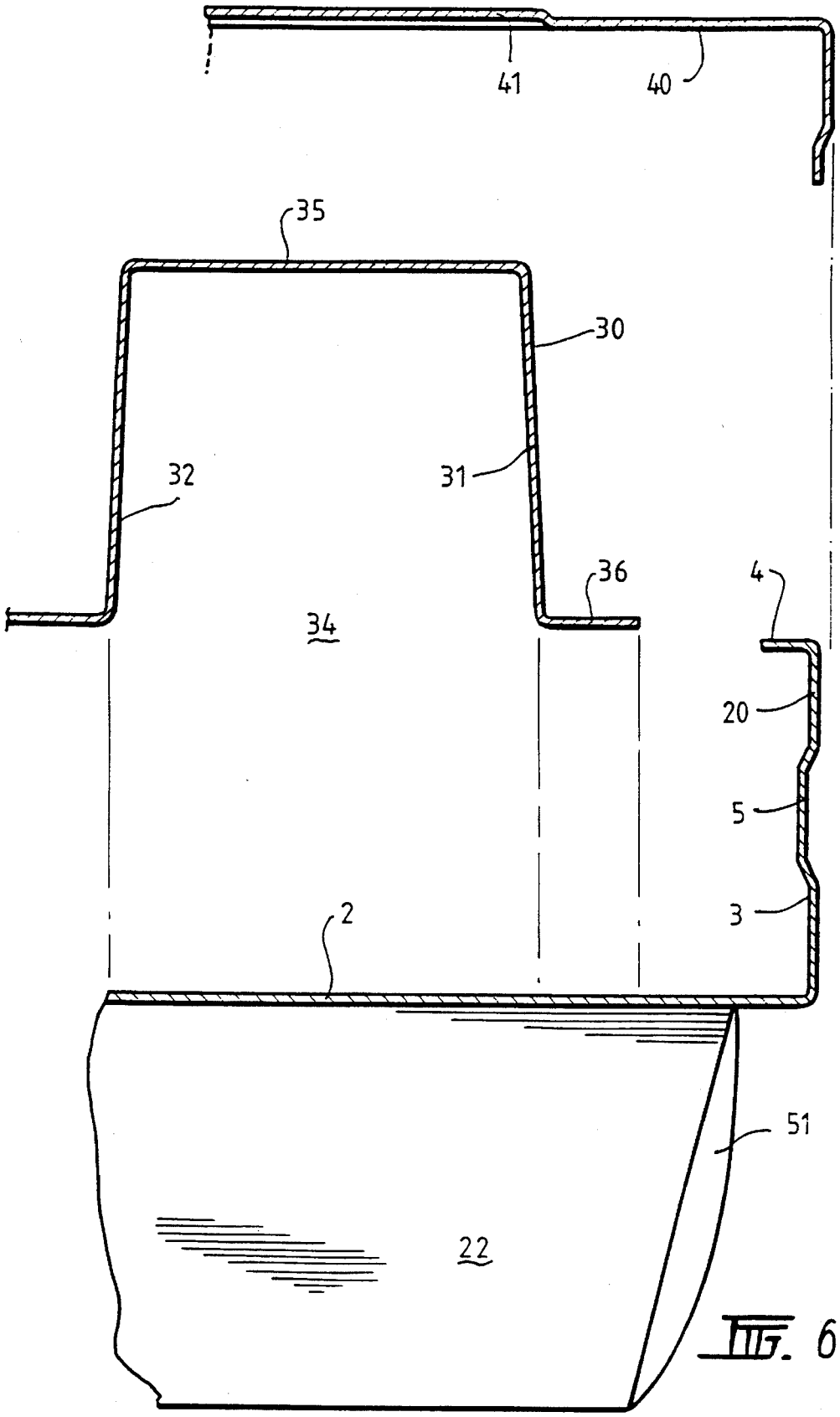
FIG. 6 is a sectional view taken along the line 6—6 of FIG. 3.
Figure 7:
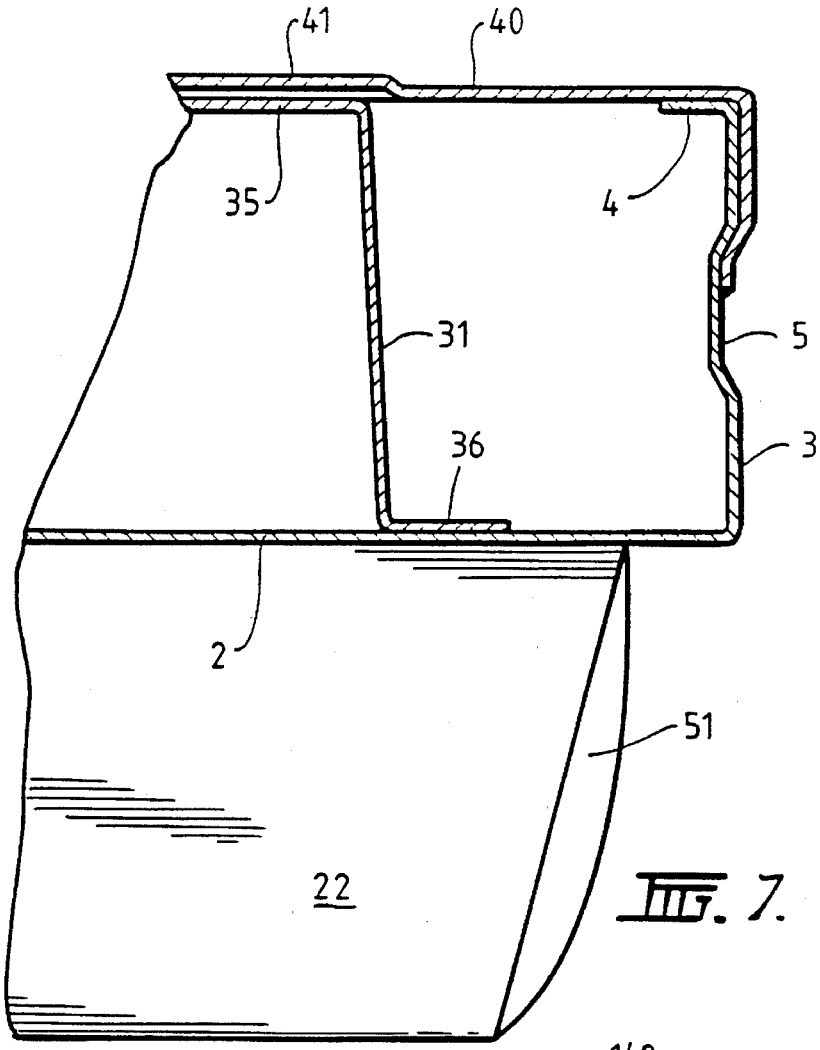
FIG. 7 is a sectional view taken along the line 7—7 of FIG. 1.

The base panel 20 is shown with reference to FIGS. 3, 6 and 7 and is rolled to define a planar horizontal base 2 bounded by a vertically upstanding peripheral flange 3 which terminates in an inwardly extending flange 4. The peripheral flange 3 is formed with a rabbet 5 at its upper mid span as shown in FIGS. 6 and 7.

Three elongate, parallel spaced apart channel members 21, 22 and 23 are separately formed to define the feet of a pallet allowing two way tyne entry. Each channel is of substantially U-shaped cross section with upwardly and outwardly inclined walls 25 and 26 and a horizontal base 27. Each wall 25 and 26 terminates in an inward flange *25a*, *26a* that is seam welded or similarly secured to the underside of the planar portion 2 of the base panel 20. The horizontal base 27 acts as the ground engaging foot of the pallet and the channel sections operate as the pallet legs. The spacing of the channel members 21, 22 and 23 defines unobstructed gaps 28 and 29 into which the conventional tynes of a forklift may be located. Although the preferred embodiment shows three channel sections defining three legs, it is understood that the pallet may be formed with only the two outer channel members 21 and 23. As shown in FIG. 3, suitable dished end closure members 51 are also arranged to be welded into the ends of the channel sections 21, 22 and 23 to seal the leg assemblies.

The bearing panel 30 shown in FIGS. 3, 6 and 7 is formed of a corrugated structure with corrugations 33 defining angles slightly greater than 90°. The walls 31, 32 of the corrugations 33 taper outwardly so that the open mouth 34 of each corrugation is about 5 mm wider than the base 35. The edges 36 and 37 of the bearing panel 30 running parallel to the corrugations 33 locate on the planar base of the base panel 20 inwardly of the peripheral flange 3 as shown in FIG. 7. The load bearing panel 30 is positioned on the base panel 20 with the corrugations 33 extending transversely to the channel sections 21, 22, 23 that define the legs of the pallet. As shown in FIGS. 6 and 7, the upper surfaces 35 of the corrugations 33 extend horizontally, acting as support surfaces for the underside of the top panel 40. The top panel 40 is provided with small upstanding ribs 41 equally spaced along the length of the panel. The ribs are arranged to extend perpendicularly to the corrugations 33 in the bearing panel 30. The ribs 41 are pressed into the top panel 40 to improve the strength of the panel and also to improve the load stability of the pallet when in use.

As shown in detail in FIGS. 6 and 7 the top panel 40 is bounded by a downwardly extending peripheral flange 42 that terminates in an inturned peripheral rim 43. The dimensions of the rim 43 and flange 42 are such that the top panel can resiliently clip onto the peripheral flange 3 of the base panel with the rim 43 locating with the rabbet 5 and the upper flange 4 abutting the underside of the top panel 40. The abutting surfaces of the top and base panels 20 and 40 are coated with a suitable adhesive to firmly secure and seal the enclosure defined by the two panels. The load bearing panel 30 is sandwiched between the top and base panels and is adhesively secured to the abutting surfaces of both panels through the contact of the sides 36 and 37 and tops 35 of the corrugations 33.

Figure 1:
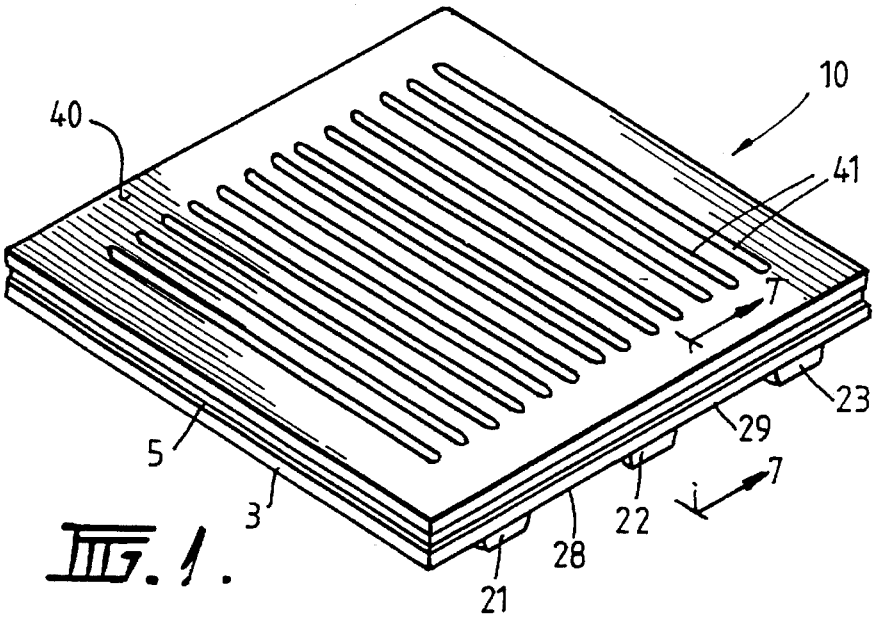
FIG. 1 is a perspective view of a pallet in accordance with one embodiment of the invention.
Figure 2:
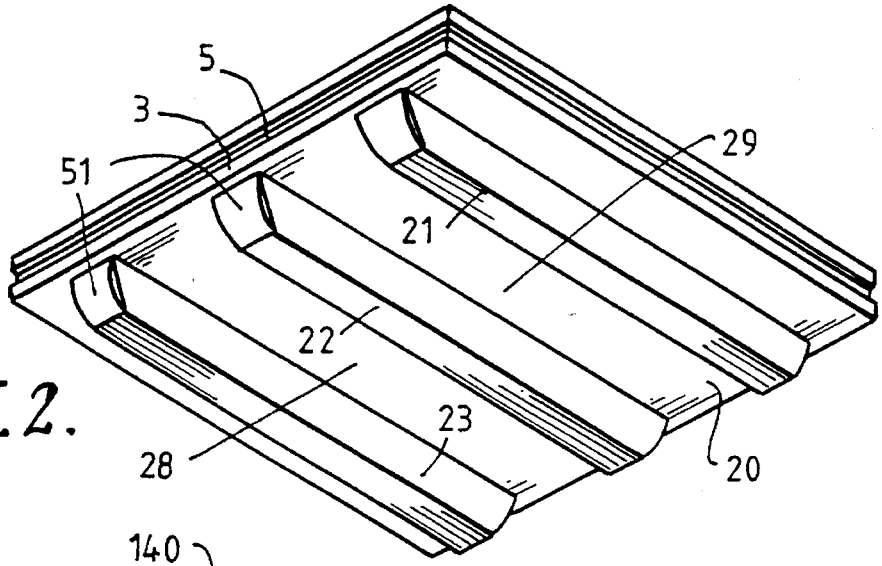
FIG. 2 is an underside perspective view of the pallet facilitating two way tyne entry.
Figure 4:
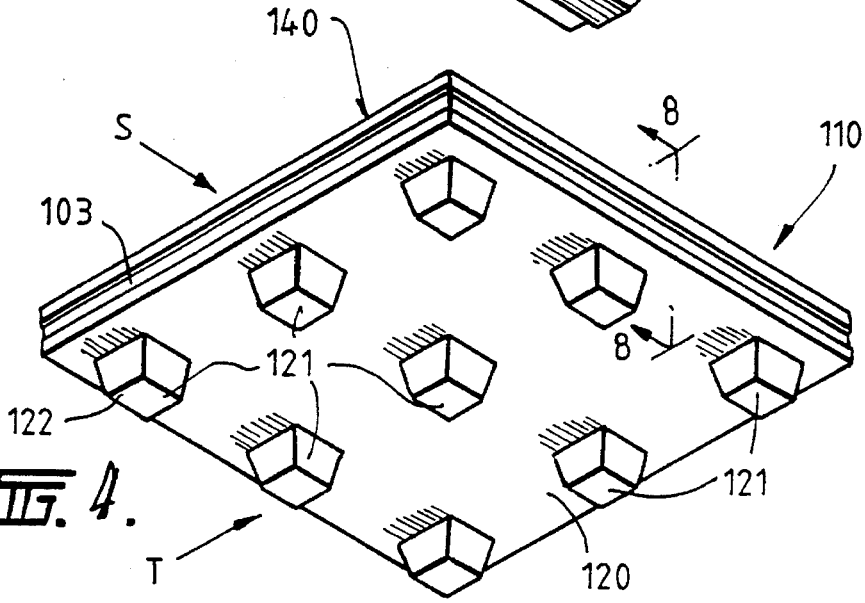
FIG. 4 is an underside perspective view of another form of pallet facilitating four way tyne entry.
Figure 5:
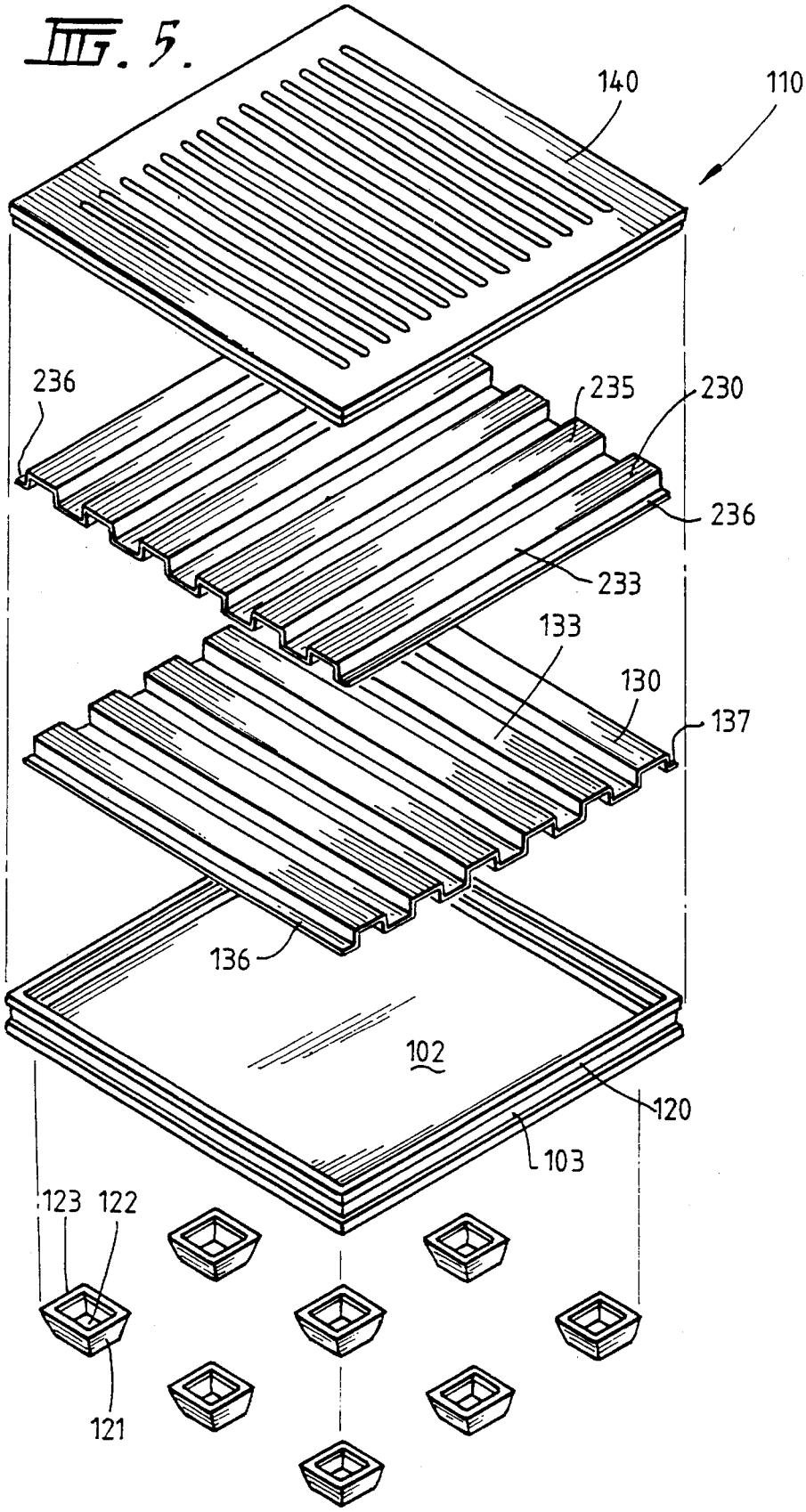
FIG. 5 is an exploded perspective view of the pallet shown in FIG. 4.
Figure 8:
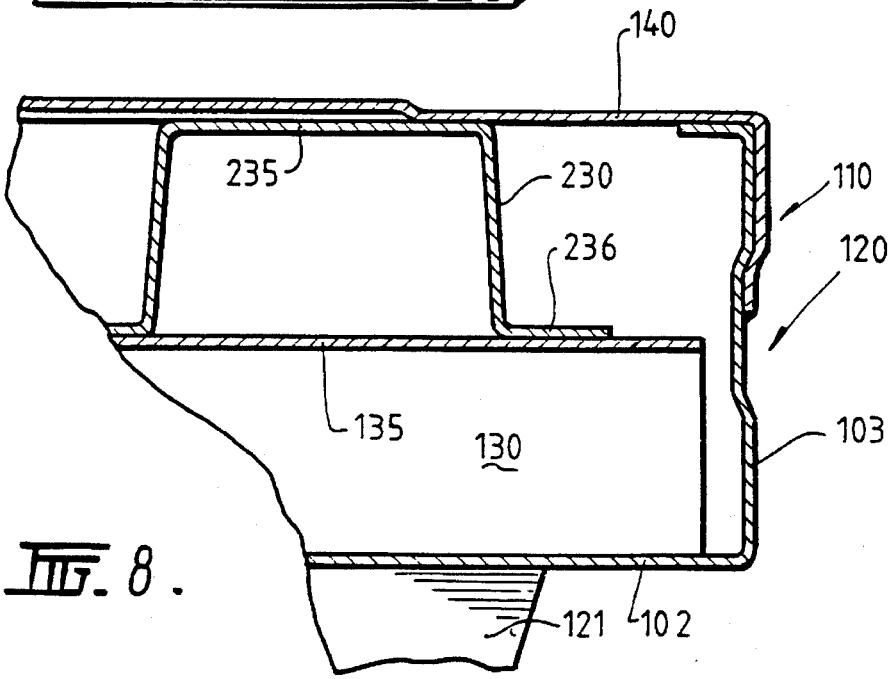
FIG. 8 is a sectional view taken along the line 8—8 of FIG. 4.

In the embodiment of FIGS. 4, 5 and 8 a pallet 110 facilitating four way tyne entry is illustrated. The pallet 110 is "four way" because it facilitates tyne entry from either side or end. The main differences between this pallet 110 and the pallet 10 of the first embodiment concern the replacement of the elongate channel sections 21, 22, 23 with an array of nine discrete foot members 121. The foot members 121 are welded to the underside of the base panel 120 in three spaced apart rows as shown in FIG. 4. The gaps between the foot members allow tyne access in the directions T and S (FIG. 4). Each foot member 121 is fabricated to be of tapering square cross section with a planar ground engaging base 122 and inturned mounting flange 123 which is welded or bonded to the underside of the base panel 120. Although nine foot members 121 are illustrated in FIG. 7, it is understood that a lesser number such as eight or four foot members is also envisaged.

As shown in FIG. 5, the pallet 110 of this embodiment also includes two load bearing panels 130 and 230 both corrugated as in the first embodiment but mounted one 230 on top of the other 130 with the corrugations 133, 233 extending mutually perpendicularly. The load bearing panels 130 and 230 fit into the enclosure defined by the peripheral flange 103 of the base panel 120 with the lateral edges 136 and 137 of the panels 130 resting on the planar base 102 of the base panel 120 and the lateral edges 236 of the upper load bearing panel 230 resting on the tops 135 of the corrugation 133 of the load bearing panel 130. The load bearing panels 130 and 230 are sandwiched together between the upper panel 140 and base panel 120 as shown in FIG. 8. The side location and means of adhesive securement is as in the first embodiment.

The pallets illustrated are particularly suitable for the food industry due to the ability of the pallet to be steam cleaned or sterilised. The sealed enclosure of the pallet ensures that there is no entry of liquids or solids and renders the pallet extremely easy to clean. Furthermore, the componentry of the pallet is not permeable and therefore there is no likelihood of cross contamination. The pallet has also been designed to be used in other industries such as the chemical or petroleum industry. Depending on the material selected for the pallet, it is envisaged that pallets of the kind described above could be used in a wide variety of applications. The base structure of the pallet is designed to provide unobstructed elongate channels for access from either side. The unobstructed access is particularly advantageous when the pallet is being used with hand lifts which have tynes running on small wheels that travel along the channels between the legs as the hand lift is placed under the pallet. The construction of the pallet is such that it can withstand a wide range of temperatures under full load.

The preferred adhesive is a thermosetting adhesive such as ARALDITE®. A rubberised thermosetting adhesive is more suitable for use at the sides of the pallet. The feet may be attached to the base panel through a combination of welding and adhesives.

I claim:

1. A pallet fabricated in steel from a base panel, at least one load bearing panel and a top panel, the panels interfitting so that the at least one load bearing panel is sandwiched between the top and base panels, the base panel having an upstanding peripheral side portion that terminates in an inwardly projecting upper flange, the top panel having a downwardly extending peripheral side portion that extends over and in contact with the side portion of the base panel with the underside of the top panel abutting the upper flange of the base panel, and means to secure and seal the overlapping side portions to define a sealed enclosure, the pallet having downwardly projecting legs which facilitates at least two way tyne entry.

2. The pallet according to claim 1 wherein the at least one load bearing panel includes corrugations and corrugations of said least one load bearing panel are in abutment with the top and base panels.

3. The pallet according to claim 2 wherein the abutting surfaces of the panels are adhesively secured together.

4. The pallet according to claim 2 wherein the corrugations are of rectangular cross-section.

5. The pallet according to claim 2 wherein two load bearing panels are superimposed, one upon the other with the corrugations of each panel extending mutually perpendicular.

6. The pallet according to claim 1 wherein the means to seal and secure the overlapping flanges comprises adhesive.

7. The pallet according to claim 6 wherein the abutting portions are coated with adhesive.

8. The pallet according to claim 1 wherein the legs are defined by at least two elongate channels secured to extend downwardly from the underside of the base panel in a parallel spaced apart array to allow unobstructed two way tyne entry.

9. The pallet according to claim 1 wherein the legs are defined as an enclosure secured to the underside of the base panel adjacent each corner of the panel to define unobstructed four way tyne entry.

10. The pallet according to claim 9 wherein a further enclosure is positioned adjacent the mid-span of each side edge of the base panel.

11. The pallet according to claim 1 wherein the top panel is provided with upwardly projecting spaced apart parallel ribs.

* * * * *